US008669697B2

(12) United States Patent
Igl

(10) Patent No.: US 8,669,697 B2
(45) Date of Patent: Mar. 11, 2014

(54) COOLING LARGE ARRAYS WITH HIGH HEAT FLUX DENSITIES

(75) Inventor: Scott Igl, Portland, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 439 days.

(21) Appl. No.: 13/030,635

(22) Filed: Feb. 18, 2011

(65) Prior Publication Data

US 2011/0222281 A1 Sep. 15, 2011

Related U.S. Application Data

(60) Provisional application No. 61/313,062, filed on Mar. 11, 2010.

(51) Int. Cl.
*F21V 29/00* (2006.01)

(52) U.S. Cl.
USPC ..... 313/373; 362/294; 313/46

(58) Field of Classification Search
USPC ..... 313/46; 362/249.01, 294, 373
See application file for complete search history.

(56) References Cited

U.S. PATENT DOCUMENTS

| | | | | |
|---|---|---|---|---|
| 5,857,767 | A | 1/1999 | Hochstein | |
| 5,936,353 | A | 8/1999 | Triner et al. | |
| 6,200,134 | B1 | 3/2001 | Kovac et al. | |
| 6,457,823 | B1 | 10/2002 | Cleary et al. | |
| 6,501,084 | B1 | 12/2002 | Sakai et al. | |
| 6,683,431 | B2 | 1/2004 | Fitzgibbon et al. | |
| 6,692,250 | B1 | 2/2004 | Decaudin et al. | |
| 7,345,320 | B2 | 3/2008 | Dahm | |
| 2001/0046652 | A1 | 11/2001 | Ostler et al. | |
| 2002/0187454 | A1 | 12/2002 | Melikechi et al. | |
| 2003/0043582 | A1 | 3/2003 | Chan et al. | |
| 2003/0081096 | A1 | 5/2003 | Young | |
| 2007/0090737 | A1* | 4/2007 | Hu et al. | 313/11 |
| 2007/0187072 | A1* | 8/2007 | Chin et al. | 165/104.26 |
| 2009/0129075 | A1* | 5/2009 | Shuai et al. | 362/234 |
| 2009/0251901 | A1* | 10/2009 | Kuo et al. | 362/294 |

FOREIGN PATENT DOCUMENTS

| | | | |
|---|---|---|---|
| DE | 19619154 | A1 | 6/1997 |
| DE | 10127171 | A1 | 12/2001 |
| EP | 0879582 | A1 | 11/1998 |
| EP | 1158761 | A1 | 11/2001 |
| WO | 9507731 | A1 | 3/1995 |
| WO | 0059671 | A1 | 10/2000 |
| WO | 0067048 | A2 | 11/2000 |
| WO | 0211640 | A2 | 2/2002 |
| WO | 0213231 | A2 | 2/2002 |
| WO | 03023875 | A2 | 3/2003 |

OTHER PUBLICATIONS

Data Sheet for G*SiC Technology Super Blue LEDs No. C430-CB290-E1200, manufactured by Opto Semiconductors, May 1, 1999, 8 pages.

Data Sheet for 5.0 mm Blue Series LEDs No. LNG992CFB, manufactured by the Panasonic Corporation, Mar. 2001, 1 page.

Data Sheet for 3.0 mm Blue Series LEDs No. LNG997CKB, manufactured by the Panasonic Corporation, Mar. 2001, 1 page.

* cited by examiner

*Primary Examiner* — Joseph L Williams

(74) *Attorney, Agent, or Firm* — Alleman Hall McCoy Russell & Tuttle LLP

(57) ABSTRACT

A lighting module includes an array of light emitters, a heat pipe having a flat portion, the array of light emitters being mounted to the flat portion, a liquid inside the heat pipe, the liquid selected to vaporize upon exposure to heat from the array, and a cooling unit thermally coupled to the heat pipe configured to cool the vaporized liquid.

16 Claims, 4 Drawing Sheets

COOLING LARGE ARRAYS WITH HIGH HEAT FLUX DENSITIES

CROSS-REFERENCE TO RELATED APPLICATIONS

This application claims priority from co-pending provisional patent application Serial No. 61/313,062, entitled COOLING LARGE ARRAYS WITH HIGH HEAT FLUX DENSITIES, filed Mar. 11, 2010, which is herein incorporated by reference in its entirety.

BACKGROUND

Solid-state light emitting devices, such as light-emitting diodes (LEDs), have become more common in curing applications such as those using ultra-violet light. Solid-state light emitters have several advantages over traditional mercury arc lamps including that they use less power, are generally safer, and are cooler when they operate.

However, even though they generally operate at cooler temperatures than arc lamps, they do generate heat. Since the light emitters generally use semiconductor technologies, extra heat causes leakage current and other issues that result in degraded output. Management of heat in these devices has become important.

One traditional cooling technique uses a heat sink, which generally consists of thermally conductive materials mounted to the substrates upon which the light emitters reside. Some sort of cooling or thermal transfer system generally interacts with the back side of the heat sink, such as heat dissipating fins, fans, liquid cooling, etc., to draw the heat away from the light emitter substrates. The efficiency of these devices remains lower than desired, and liquid cooling systems can complicate packaging and size restraints.

DESCRIPTION OF THE EMBODIMENTS

Figure 1:
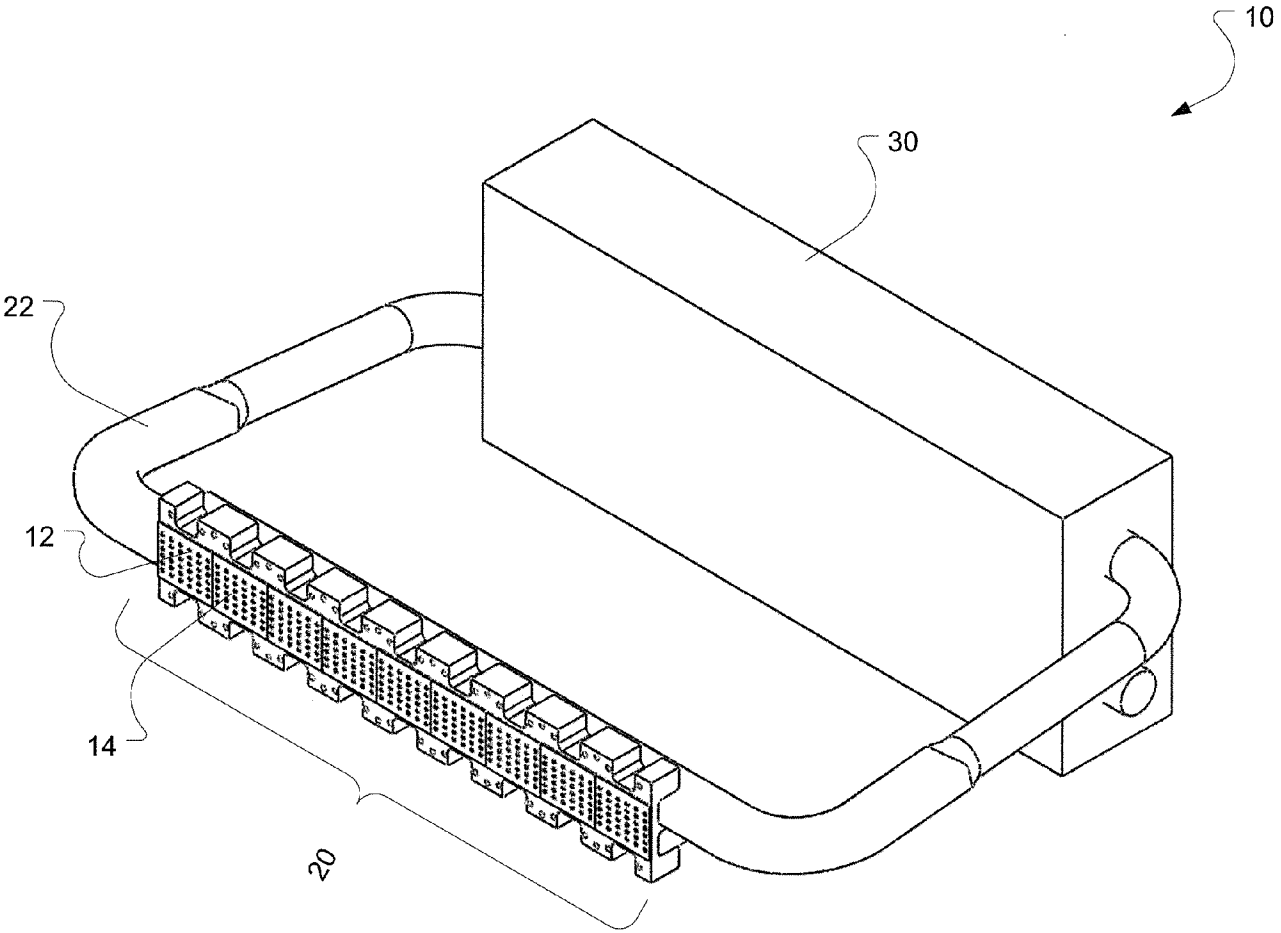
FIG. 1 shows an embodiment of a large area array of light emitters with a heat pipe.

FIG. 1 shows an embodiment of a lighting module 10 having a heat pipe 22. In this embodiment, the light module 10 consists of a large array of light emitters 20. The large array of light emitters 20 includes several substrates such as 12 and 14 that each contains an array of individual light emitters, with the substrates being aligned and combined to form the array 20.

One must note that this shows merely an example of an array and that the array may be as few of two light emitters with the only limit on how many light emitters being the size of the package containing the array, not shown. Further, the configuration could consist of a single line of emitters, or multiple substrates stacked in both the vertical and horizontal direction, and any combination in between.

The substrates of the array may mount directly to a plate or flat portion of the heat pipe 22. In one embodiment, the substrates are brazed or otherwise mounted to the heat pipe directly. In another embodiment a heat sink designed specifically for the arrays is brazed onto the heat pipe before or after the substrates have been mounted to the heat sink. In yet another embodiment, the substrates are mounted to the pipe using a thermal interface material, such as thermal grease.

The heat pipe 22 is hollow and may contain a liquid and may include internal wicking structures. In its simplest form, the heat pipe merely contains liquid that vaporizes and draws heat from the array 20. As the gas rises towards the cooling unit 30, it is cooled and runs back down to the area of the pipe adjacent the array. The liquid may be water, ethylene glycol, mercury, or a fluorocarbon-based cooling fluid, an example of which includes Fluorinet®.

In one embodiment, the heat pipe contains a small amount of liquid that vaporizes when exposed to the heat from the array 20. The vapor rises to the cooling unit, converts back to liquid and then runs back down to the area of the pipe adjacent the array. Varying levels of liquid may be used and are well within the scope of the embodiments here.

To facilitate the phase conversion from gas to liquid and back, the internal structure of the heat pipe may include a wicking structure such as a mesh or other material that eases the movement of the liquid and/or gas via capillary action.

Regardless of the mechanism inside the heat pipe, such as type or varying amounts of liquid, the heat pipe system is generally a closed system with no pumps or other mechanical means needed to transport cooling liquid or gas near the substrate. This may serve to simplify packaging requirements, as the cooling unit may be remote to the actual device employing the lighting module. It also increases reliability.

The cooling unit 30 may take many forms. One embodiment shown in FIG. 2 has a fan 32 blowing cool air across the heat pipe at the portion away from the arrays 20.

Figure 2:
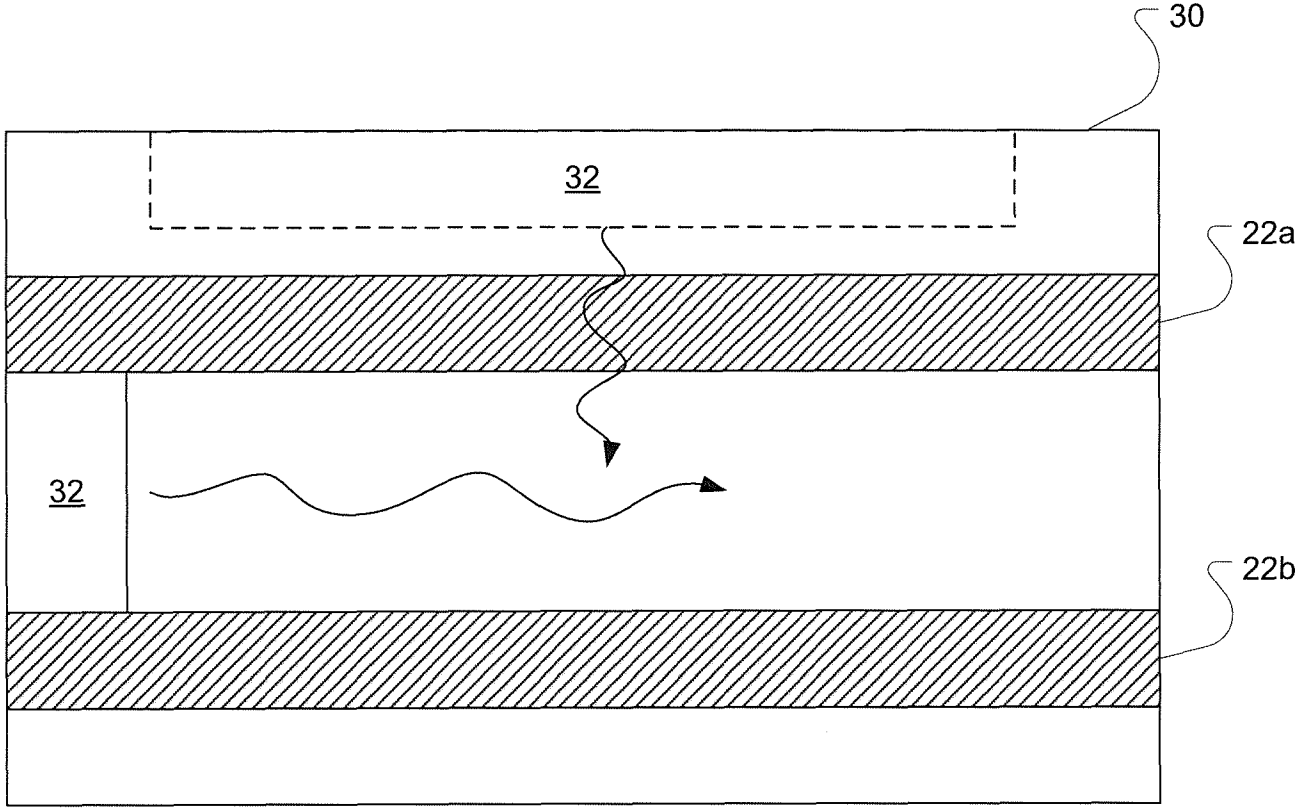
FIG. 2 shows one embodiment of a cooling unit.

FIG. 2 shows the inside of the cooling unit 30 with the back portion away from the arrays 20 removed. The heat pipe portions 22*a* and 22*b* may also be one portion of the heat pipe. The fan 32 may be oriented in any position, such as to blow the air along the pipe horizontally in the figure, or across the pipes blowing the air from top to bottom as oriented in the figure. Other configurations and positions are of course possible.

Figure 3:
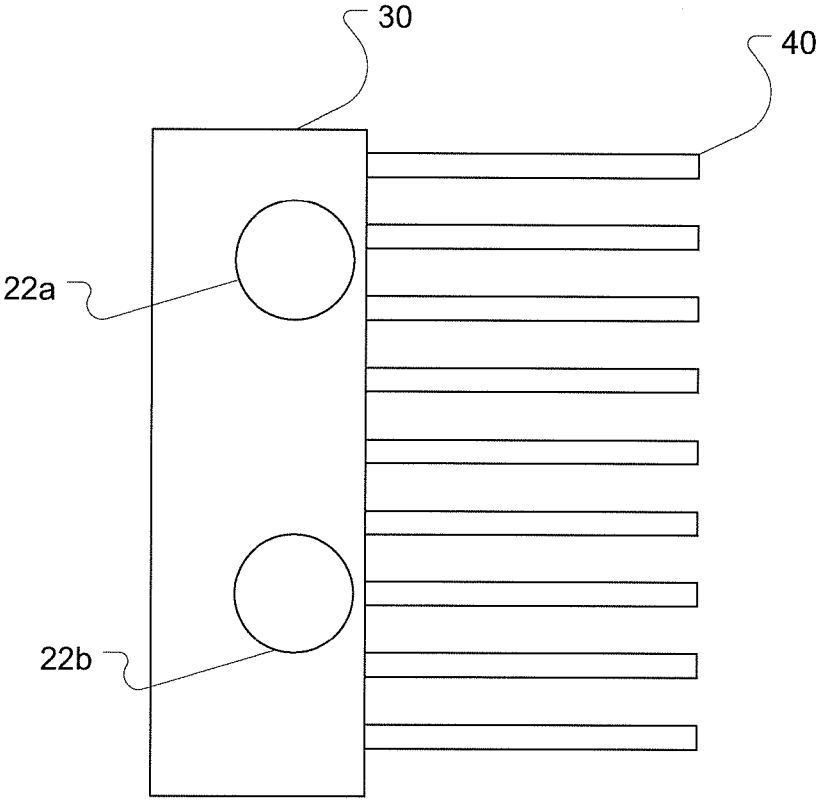
FIG. 3 shows an alternative embodiment of a cooling unit.

The heat pipe or cooling unit may have ridges or fins in this portion to assist in the dissipation of heat through increased surface area producing forced convection, as shown in FIG. 3. The fins such as 40, may reside on the cooling unit 30, extending as shown, or extending along the length of the pipe perpendicularly.

Another air-cooled approach would be to use free air convection by eliminating fans.

Figure 4:
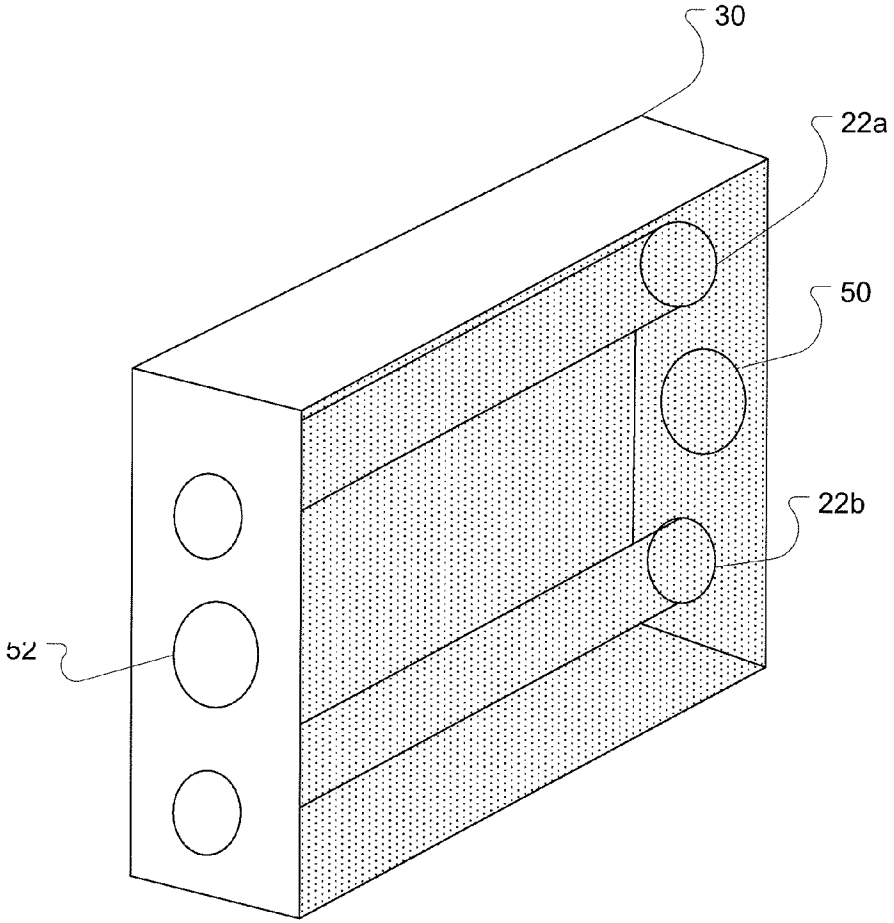
FIG. 4 shows an alternative embodiment of a cooling unit.

FIG. 4 shows another embodiment of the cooling unit 30 that is a liquid manifold clamped around the heat pipe in which cooled liquid flows around the pipe to cool the substance inside and then circulates warmed liquid away from the heat pipe to allow the warmed liquid to be re-cooled. This may involve pumps and other mechanical means of moving the liquid through the ports 52 and 50, but it is further removed from the light emitter substrates than having the liquid in direct contact with the heat sinks near the array 20. As mentioned previously, the heat pipe here is shown as having two portions 22*a* and 22*b*, but may consist of only one portion.

One advantage of heat pipes lies in their isothermal nature. Because of the nature of the materials used, the heat pipe will 'seek' to keep everything the same temperature. This inherent heat balancing characteristic has special significance when the device being cooled involved several discrete components, such as light emitting device substrates.

Each substrate may have its own slightly different heat profile and a system that seeks equilibrium across all of the area of the heat pipe will balance the temperature profiles across the components improving uniformity.

Another advantage results from the lighter weight of the heat pipe, making the overall lighting module lighter.

In this manner, a lighting module can employ a heat pipe to dissipate heat away from the array of light emitters. This allows the light emitters to operate more efficiently at cooler temperatures, using less power with more consistent performance and with a longer lifetime.

Although there has been described to this point a particular embodiment for a solid-state light emitter light module using a heat pipe, it is not intended that such specific references be considered as limitations upon the scope of these embodiments.

What is claimed is:

1. A lighting module, comprising:

an array of light emitters comprising at least one substrate having multiple light emitters arranged on the substrate;

a heat pipe having a flat portion, the array of light emitters being mounted to the flat portion, and two non-flat end portions;

a liquid inside the heat pipe, the liquid selected to vaporize upon exposure to heat from the array; and a cooling unit thermally coupled to the heat pipe configured to cool the vaporized liquid, the non-flat end portions of the heat pipe extending past the substrate and into the cooling unit.

2. The lighting module of claim 1, wherein the non-flat end portions are spaced away from each other inside the cooling unit.

3. The lighting module of claim 1, wherein the array of light emitters comprises multiple substrates, the substrates being one of either stacked in both a vertical and horizontal direction or stacked in a horizontal direction.

4. The lighting module of claim 1, wherein the array of light emitters comprises a single line of emitters.

5. The lighting module of claim 1 wherein the heat pipe comprises one of copper, aluminum or brass.

6. The lighting module of claim 1, wherein the liquid comprises one of water, alcohol, ethylene glycol, or fluorocarbon-based fluid.

7. The lighting module of claim 1, wherein the cooling unit comprises a fan inside the cooling unit arranged above the non-flat end portions, the fan configured to blow air across non-flat end portions.

8. The lighting module of claim 1, wherein the cooling unit comprises one of either ridges or fins in a portion of the heat pipe away from the arrays.

9. The lighting module of claim 1, wherein the cooling unit comprises a liquid manifold clamped around the non-flat end portions of the heat pipe, the liquid manifold containing a cooled liquid.

10. The lighting module of claim 1, wherein the array of light emitters is mounted directly to the heat pipe.

11. The lighting module of claim 1, wherein the array of light emitters is mounted to the heat pipe using an interface material.

12. The lighting module of claim 1, wherein the array of light emitters is mounted to the at least one substrate and the at least one substrate is mounted to the heat pipe.

13. The lighting module of claim 1, wherein the non-flat end portions terminate outside of opposite sides of the cooling unit.

14. The lighting module of claim 1, wherein the heat pipe is a closed system with no pumps.

15. The lighting module of claim 1, further comprising a passage for a cooling medium between the non-flat end portions in the cooling unit.

16. The lighting module of claim 15, wherein the cooling unit further comprises a fan inside the cooling unit, the fan blowing air through the passage between the end portions.

* * * * *